US010300521B2

(12) United States Patent
Meador

(10) Patent No.: US 10,300,521 B2
(45) Date of Patent: May 28, 2019

(54) METHOD AND APPARATUS FOR CURLING AN ARTICLE

(71) Applicant: BELVAC PRODUCTION MACHINERY, INC., Lynchburg, VA (US)

(72) Inventor: Gerald Meador, Hardy, VA (US)

(73) Assignee: BELVAC PRODUCTION MACHINERY, INC., Lynchburg, VA (US)

( * ) Notice: Subject to any disclaimer, the term of this patent is extended or adjusted under 35 U.S.C. 154(b) by 6 days.

(21) Appl. No.: 15/567,754

(22) PCT Filed: May 3, 2016

(86) PCT No.: PCT/US2016/030595
§ 371 (c)(1),
(2) Date: Oct. 19, 2017

(87) PCT Pub. No.: WO2016/179187
PCT Pub. Date: Nov. 10, 2016

(65) Prior Publication Data

US 2018/0133782 A1 May 17, 2018

Related U.S. Application Data

(60) Provisional application No. 62/156,666, filed on May 4, 2015.

(51) Int. Cl.
*B31F 1/00* (2006.01)
*B21D 51/26* (2006.01)

(52) U.S. Cl.
CPC ..... *B21D 51/2623* (2013.01); *B31F 1/0087* (2013.01)

(58) Field of Classification Search
CPC ..... B21D 51/2623; B21D 51/2615; B21D 51/32; B21D 19/12; B31F 1/0087
See application file for complete search history.

(56) References Cited

U.S. PATENT DOCUMENTS 7,464,573 B2 12/2008 Shortridge

FOREIGN PATENT DOCUMENTS

DE 7621025 U1 11/1976
DE 2818894 A1 11/1978
(Continued)

OTHER PUBLICATIONS

International Search Report from International Application No. PCT/US2016/030595 dated Jul. 18, 2016.

*Primary Examiner* — Teresa M Ekiert
(74) *Attorney, Agent, or Firm* — Nixon Peabody LLP

(57) ABSTRACT

An apparatus for forming a curl on an article includes a first forming tooling having a first set of rollers mounted on a common head. The first set of rollers has a respective groove having a first groove radius. The apparatus further includes a first rotating turret configured to load the article into the first forming tooling. The apparatus further includes a second forming tooling having a second set of rollers mounted on a common head. The second set of rollers has a respective groove having a second groove radius. The second groove radius is larger than the first groove radius. The apparatus further includes a second rotating turret configured to load the article into the second forming tooling. The apparatus further includes a first transfer star wheel configured to transfer the article from the first rotating turret to the second rotating turret.

14 Claims, 9 Drawing Sheets

(56) References Cited

FOREIGN PATENT DOCUMENTS

| | | | |
|---|---|---|---|
| KR | 101505780 | B1 | 3/2015 |
| RU | 2073575 | C1 | 2/1997 |
| WO | 8603471 | A1 | 6/1986 |

METHOD AND APPARATUS FOR CURLING AN ARTICLE

CROSS-REFERENCE TO RELATED APPLICATION(S)

This application is a U.S. National Stage of International Application No. PCT/US2016/030595, filed on May 3, 2016, which claims the benefit of and priority to U.S. Provisional Patent Application No. 62/156,666, filed on May 4, 2015, which is herein incorporated by reference in its entirety.

TECHNICAL FIELD

The present invention relates generally to the field of forming or processing an article, such as a beverage container or can. More specifically, the invention relates to an apparatus and method for forming a curl on an article.

BACKGROUND

Containers used, for example, for packaging liquid products, often include a container body that terminates at the top end with a radially outwardly, downwardly, and inwardly directed curl. For internally pressurized containers (e.g., aerosol containers), for example, the purpose of the curl is to support the valve cup and a gasket to seal against and strengthen the area where a connection is made to the valve cup.

Conventional curls and curling processes have been found to have several disadvantages. For example, forming a curl with a large radius presents a greater opportunity for the material to split as the material is being formed outward from its original state. This is particularly true if compression was previously applied to the material during prior necking or forming operations and/or where the container includes a welded seam along the axis of the cylindrical body of the container and the weld is harder than the base material (e.g., in aerosol containers).

It would be desirable to have methods and apparatuses that address these deficiencies.

SUMMARY

According to one aspect, an apparatus for forming a curl on an article comprises a first forming tooling having a first set of rollers mounted on a common head. The first set of rollers has a respective groove having a first groove radius. The apparatus further comprises a first rotating turret configured to load the article into the first forming tooling. The apparatus further comprises a second forming tooling having a second set of rollers mounted on a common head. The second set of rollers has a respective groove having a second groove radius. The second groove radius is larger than the first groove radius. The apparatus further comprises a second rotating turret configured to load the article into the second forming tooling. The apparatus further comprises a first transfer star wheel configured to transfer the article from the first rotating turret to the second rotating turret.

According to one process described herein, a method of forming a curl in a top edge of an article comprises feeding an article into a first rotating turret and loading the article into a first forming tooling having a first set of rollers. The method further comprises using the first set of rollers to form a curl in the top edge of the article. The curl has a first radius. The method further comprises transferring the article having the curl to a second rotating turret and loading the article having the curl into a second forming tooling having a second set of rollers. The method further comprises using the second set of rollers to modify the curl. The modified curl has a second radius, the second radius being larger than the first radius.

Still other aspects, features, and advantages of the present invention are readily apparent from the following detailed description, by illustrating a number of exemplary embodiments and implementations, including the best mode contemplated for carrying out the present invention. The present invention is also capable of other and different embodiments, and its several details can be modified in various respects, all without departing from the spirit and scope of the present invention. Accordingly, the drawings and descriptions are to be regarded as illustrative in nature, and not as restrictive. The invention is to cover all modifications, equivalents, and alternatives falling within the spirit and scope of the invention.

BRIEF DESCRIPTION OF THE DRAWINGS

Exemplary embodiments are illustrated in referenced figures. It is intended that the embodiments and figures disclosed herein are to be considered illustrative rather than restrictive.

Figure 1:
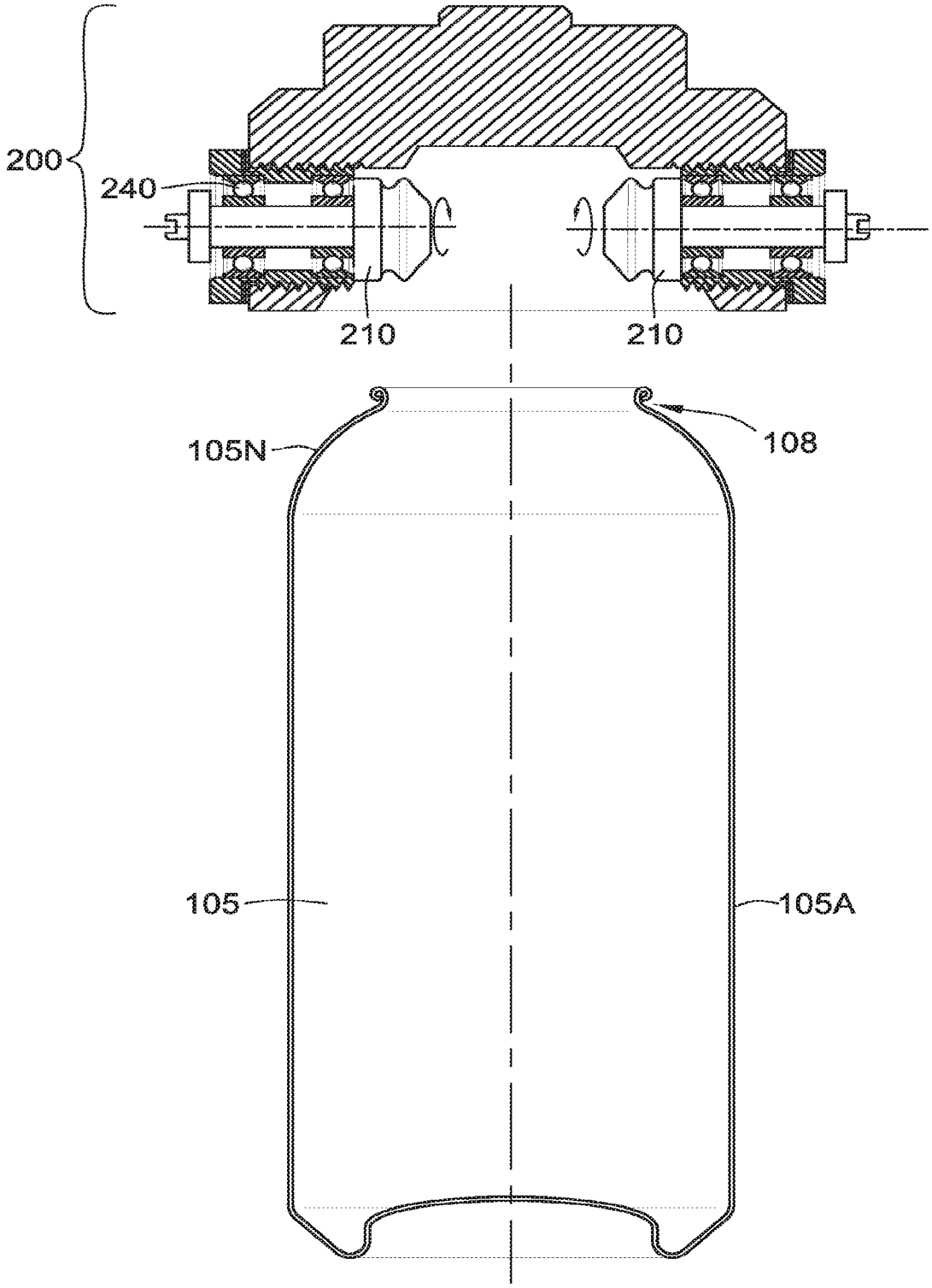
FIG. 1 is a cross-sectional view of a forming tooling of a curling apparatus with a can.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATED EMBODIMENTS

Existing curling methods and apparatus suffer from a number of significant limitations. In particular, for example, the geometry of the curl formed by existing machinery is susceptible to cracking and/or splitting as the material is being formed outward from its original state. This is especially problematic where the container has a welded seam along the axis of the cylinder that is harder than the base material (e.g., as in internally pressurized containers or aerosol cans), and/or when compression was previously applied during necking or forming operations.

According to aspects of the present disclosure, systems and methods are described for improving the integrity of containers that include a curl at the top end of the container.

FIG. 1 illustrates an exemplary article 105 for forming a curl thereon. The article 105 may be a can, any suitable food or beverage container, jar, bottle, or any other suitable article. The article 105 has an open end, opposite closed end, and a sidewall extending from the closed end. Alternatively, the article 105 may be open at both ends. A top, lid, or other closure may be added to the article 105 after the curling process.

For exemplary purposes only, the below description will describe the curling apparatus and method for use on a can 105. It is contemplated, however, that any other type of article 105 may be used.

Figure 2:
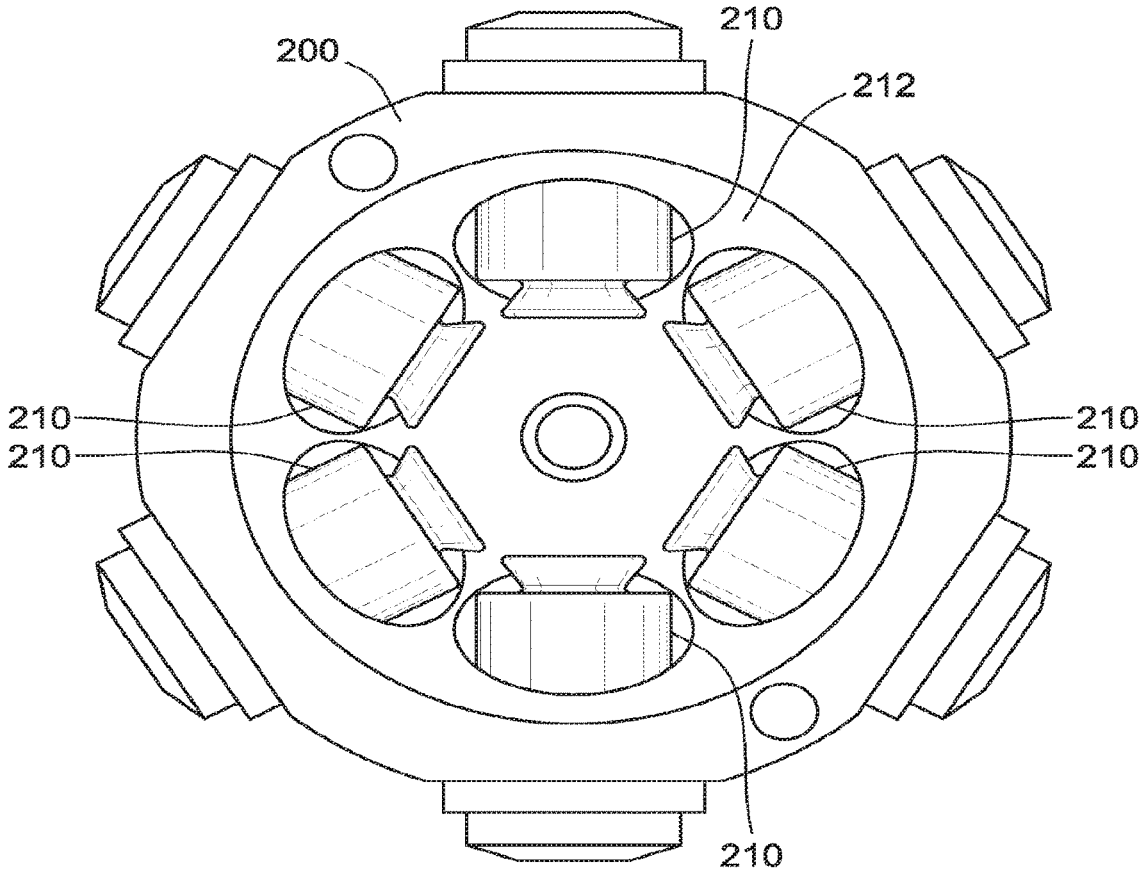
FIG. 2 is a front perspective view of a forming tooling according to one embodiment.
Figure 3A:
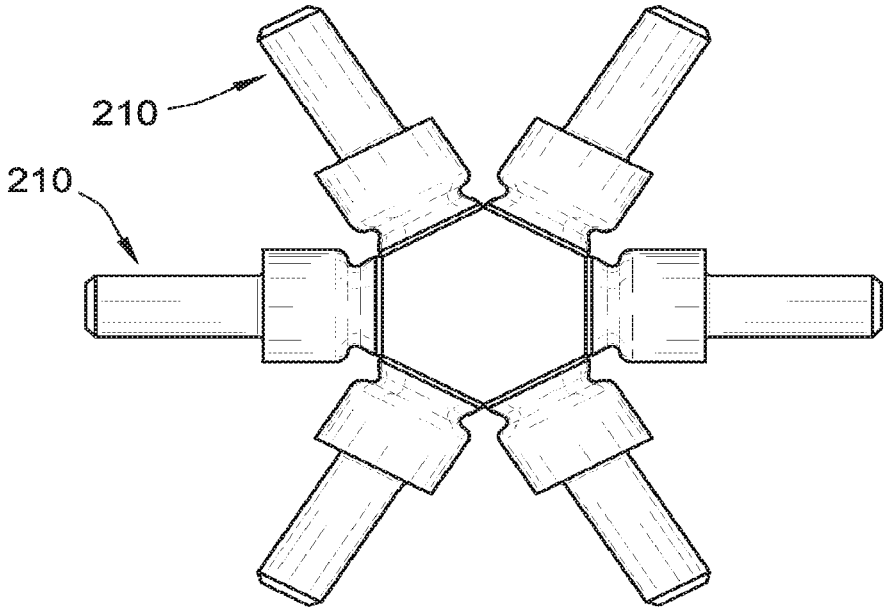
FIG. 3*a* is a top view of a set of rollers that may be used in a forming tooling according to one embodiment.
Figure 3B:
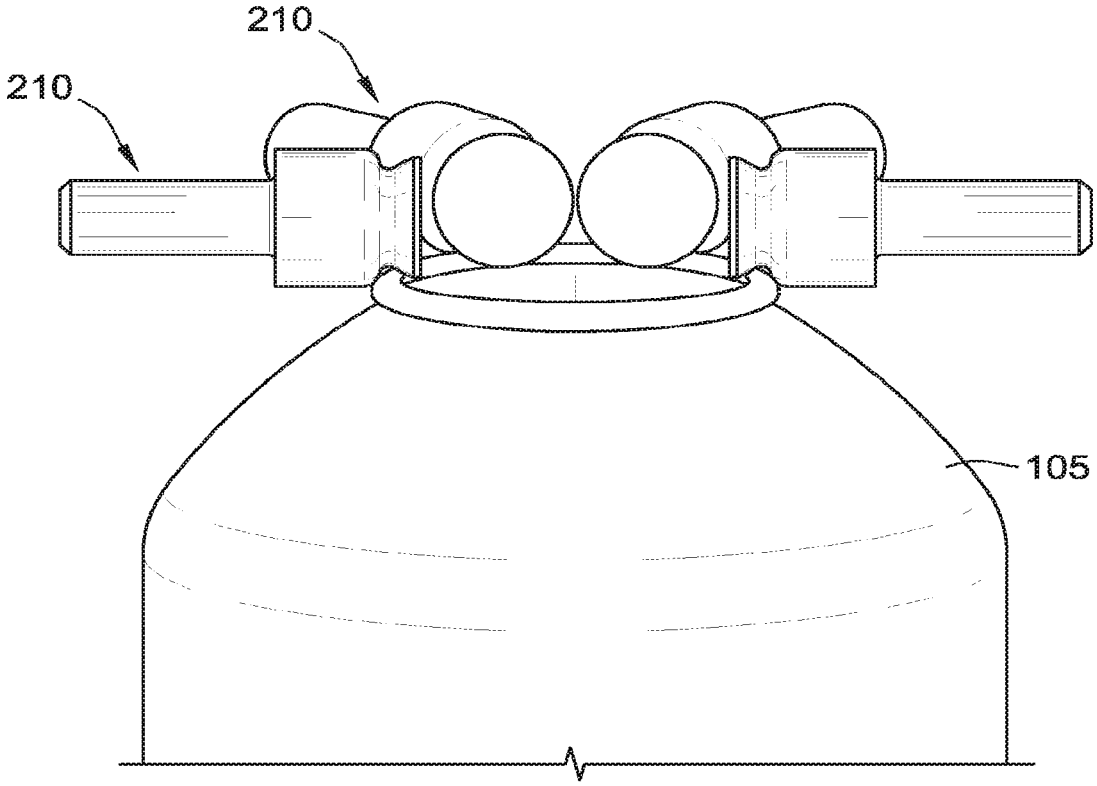
FIG. 3*b* is a perspective side view of the set of rollers of FIG. 3*b* and a container.

Curling describes a process by which the open end of a can 105 is formed into a rounded, flat, or other shape. One example of a curling process that may be used with the present invention is described in U.S. Pat. No. 7,464,573, which is hereby incorporated by reference in its entirety. For example, a forming head or tooling 200, as shown, for example, in FIGS. 1 and 2, may provide a curl comprising a rounded section and/or a flat section. The forming tooling 200 may include a first set of rollers 210 as shown, for example, in FIGS. 1, 2, 3*a*, 3*b*. Although in the illustrated embodiment, each of the plurality of rollers 210 is generally the same on the forming tooling 200, it is contemplated that two or more different kinds of rollers may be used on a single forming tooling and/or the position of the rollers on the forming tooling may be non-uniform (e.g., alternating positions, staggered, etc.). Curling may turn the open edge of the can 105 greater than 90° from its normal (initial) orientation. However, curling may comprise turning the open edge of the can 105 greater than, equal to, or less than 90°.

Figure 4:
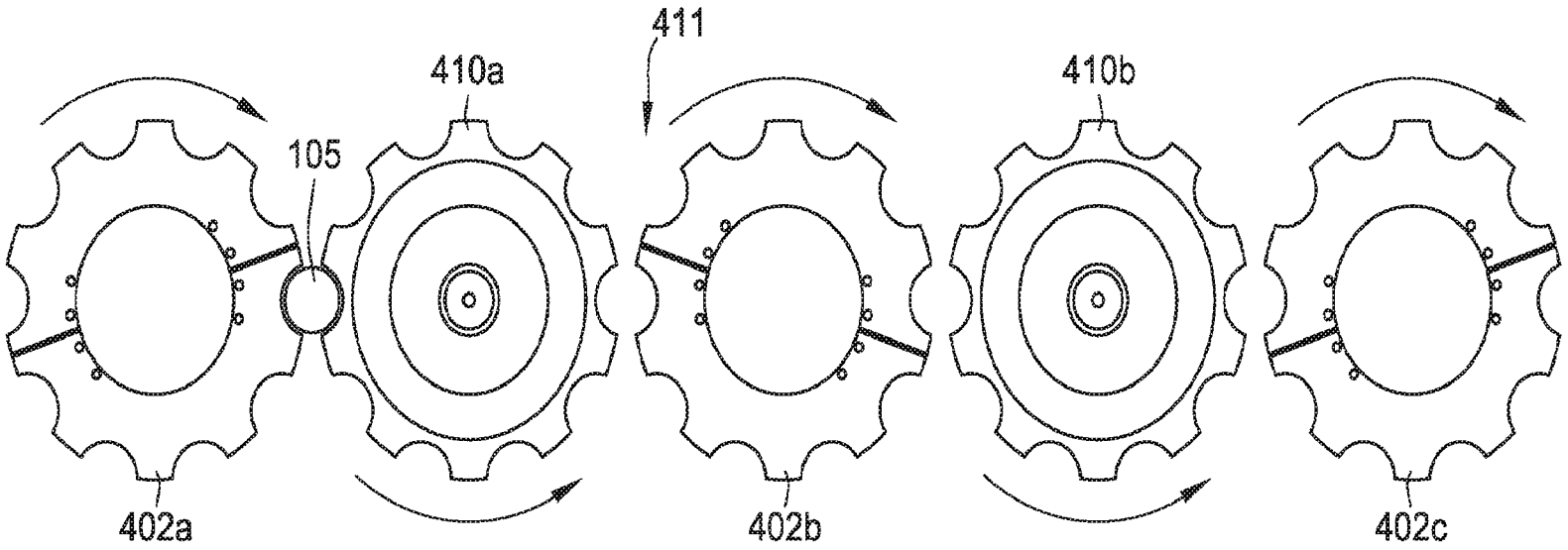
FIG. 4 is a schematic of a machine line with a can curling apparatus according to one embodiment.

In one embodiment, cans 105 may be fed into a first continuously rotating turret (e.g., turret 410*a* of FIG. 4), either from an infeed track or from a preceding process turret, which may be part of a machine line 411. FIG. 4 illustrates a turret star wheel 402*a* passing a can 105 to a first continuously rotating forming turret 410*a* of a can curling process according to one embodiment. While the first rotating turret 410*a* is rotating with the can 105 inserted into a first forming station therein, the can 105 is loaded into a first forming tooling (e.g., forming tooling 200 of FIG. 2) having a first set of rollers (e.g., rollers 210) mounted on a common head (e.g., head 212). The can 105 may be loaded into the forming tooling using, e.g., a push ram or the like. The sets of rollers described herein may include one or more rollers. As shown and described in more detail below, each of the sets of rollers includes a respective pilot with an extended portion and a groove. The groove is generally concave and has a groove radius, as shown, for example, in FIGS. 5*a*-5*d*.

Accordingly, the first set of rollers includes a respective first groove having a first groove radius. The first set of rollers is used to form a preliminary first curl having a first curl radius on an end of the can 105. The curl radius is generally measured from a straight sidewall 105A of the container 105 (see FIG. 1) to a midpoint measured horizontally between the straight sidewall 105A and the outer portion of the curl (see, e.g., FIGS. 5*a*-5*d* below).

After the first curl has been formed, the can 105 is withdrawn from the first forming tooling. The can 105 is then transferred from the first rotating turret 410*a* onto a second rotating turret 410*b* via a transfer star wheel 402*b* (see FIG. 4). While the second rotating turret 410*b* is rotating with the can 105 inserted into a second forming station thereon, the can 105 is loaded into a second forming tooling having a second set of rollers mounted on a common head. The second set of rollers has a respective second concave groove having a larger groove radius than the first groove radius of the first set of rollers. The second set of rollers (and the second grooves thereon) is used to modify the first curl formed by the first set of rollers into a second, modified curl having a second curl radius, which is larger than the first curl radius of the first curl. By forming a first curl with a smaller radius and then expanding the curl radius using subsequent process steps, as described herein, the container 105 is less susceptible to cracking or splitting because less material is displaced and placed under tension. After forming the second curl, the can is then withdrawn from the second forming tooling and may then be transferred from the second rotating turret 410*b* onto another process turret (not shown) or to a discharge track or star wheel 402*c*, in the direction illustrated by the arrows in FIG. 4.

Figure 5A:
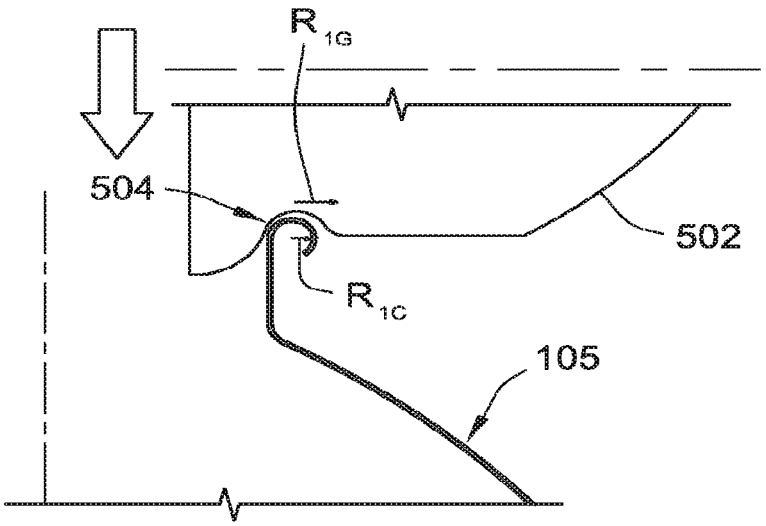
FIGS. 5*a*-5*d* illustrate close-up side views of a curl being formed and modified using various rollers.

One example of a multiple stage process for forming a curl on an article in accordance with the present disclosure is shown in FIGS. 5*a*-5*d*. Referring to FIG. 5*a*, a can 105 positioned in a first rotating turret (e.g., turret 410*a* of FIG. 4) is loaded into a first forming tooling having a first set of one or more rollers 502, a portion of which is shown in FIG. 5*a*. The first set of rollers 502 has a first groove radius $R_{1G}$. The first groove radius $R_{1G}$ may range from about 0.01 to about 0.04 inches. The resulting first curl 504 has a first curl radius $R_{1C}$ that is smaller than a final curl radius $R_{FC}$ (see FIG. 5*d*) such that less can material is displaced and less tension is created as the can material moves outward and is tucked inward, thereby lessening the chances for a crack or split in the can material.

Figure 5B:
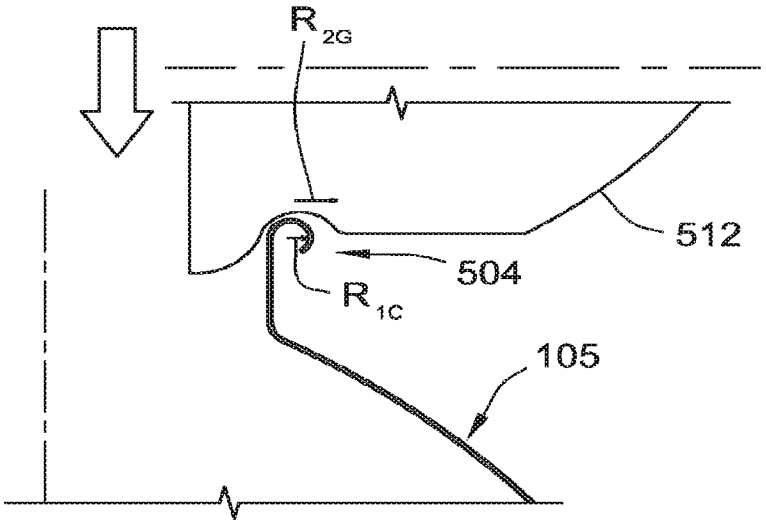
Figure 5C:
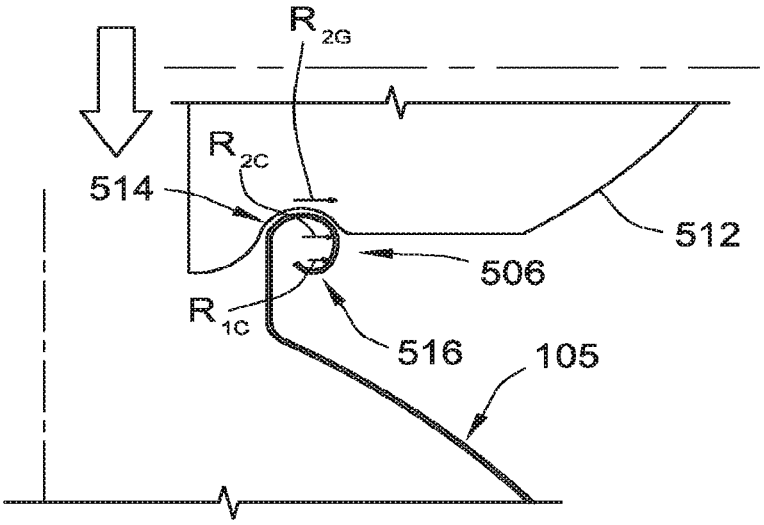
Figure 5D:
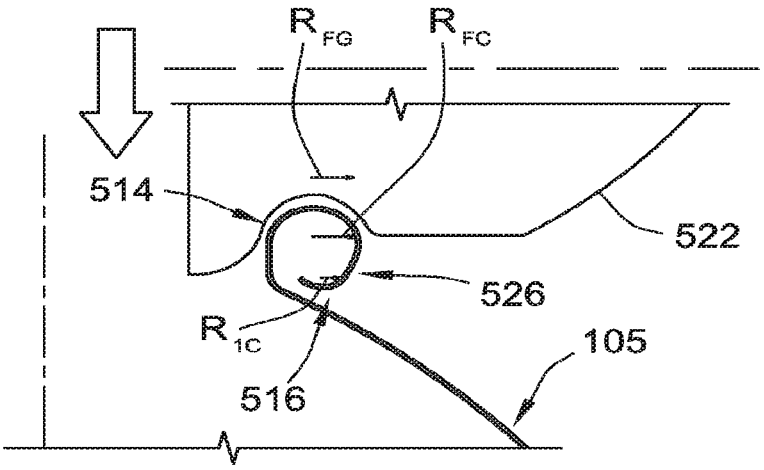

The resulting can 105 is then withdrawn from the first forming tooling and transferred, via the first star wheel 402*b*, to a second rotating turret 410*b*, where the can 105 is loaded into a second forming station and then into a second forming tooling having a second set of rollers 512, a portion of which is shown in FIG. 5*b*. The second set of rollers 512 has a second groove radius $R_{2G}$ that is larger than the first groove radius $R_{1G}$, as shown in FIG. 5*b*. FIG. 5*b* shows the can 105 and first curl 504 prior to modification by the second set of rollers 512. As the second set of rollers 512 are applied to the can 105 and, more specifically, the first curl 504, the first curl 504 is modified into a second modified curl 506, as shown in FIG. 5*c*. A second curl radius $R_{2C}$ near the top 514 of the modified curl 506, which contacts the second set of rollers 512, expands to generally conform to the second groove radius $R_{2G}$, while the first curl radius $R_{1C}$ near the bottom 516 of the modified curl 506 remains generally rigid and, as such, generally remains in its originally formed state (see FIG. 5*a*), since less tension is applied at that area. It should be noted, however, that, in some embodiments, the curl radius near the bottom 516 of the modified curl 506 may also be modified (e.g., slightly expand from its originally formed state of FIG. 5*a*) during the process shown in FIGS. 5*b*-5*c*. Generally, however, the first curl radius $R_{1C}$ near the bottom 516 of the modified curl 506 is smaller than the second curl radius $R_{2C}$ near the top 514 of the modified curl 506.

The resulting can is then withdrawn from the second forming station. If the modified curl 506 meets the desired/specified dimensions of a final curl, the can 105 may then be transferred to a discharge star wheel. If, however, further modification of the curl is desired, the can may be transferred to a third rotating process turret (not shown) into a third forming station via a third star wheel (e.g., star wheel 402*c*). The can may then be loaded into a third forming tooling having a third set of rollers 522. In the illustrated embodiment of FIGS. 4 and 5*a*-5*d*, the third forming tooling is the final forming tooling. However, it is contemplated that any suitable number of process turrets and forming toolings may be used.

The third set of rollers 522 has a final groove radius $R_{FG}$ that forms a final curl 526 to the desired/specified dimensions. The final groove radius $R_{FG}$ is larger than the first groove radius $R_{1G}$. In some embodiments, such as in the illustrated embodiment, the groove radius increases as the can moves down the process line. In this way, the tension applied to the can material can be minimized, since less material is displaced during each stage of the process, thereby resulting in less cracking and/or splitting of the can material. It is also contemplated that the groove radius of the third set of rollers (or a set of rollers further down the process line, such as the final set of rollers) may have multiple radii. For example, the groove radius may have a combination of larger and smaller radii, one or more straight sections, combinations thereof, or the like such that the final curl conforms to desired/specified dimensions.

As the third set of rollers 522 is applied to the can and, more specifically, the modified curl 506, a final curl radius $R_{FC}$ near the top of the resulting, final curl 526, which contacts the third set of rollers 522, expands to generally fit within the final groove radius $R_{FG}$ of the third set of rollers 522. As described above with respect to FIGS. 5*b*-5*c*, the first curl radius $R_{1C}$ near the bottom 516 of the final curl 526 remains smaller than the final curl radius $R_{FC}$ near the top 514 of the final curl 526.

Figure 6A:
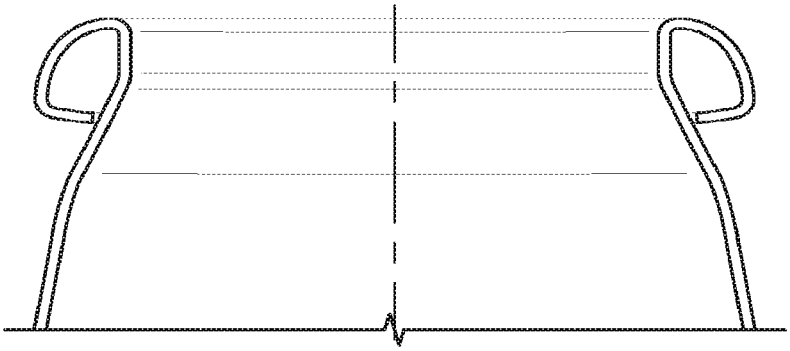
FIGS. 6*a*-6*b* illustrate examples of other curl geometries that may be formed using the methods described herein.
Figure 6B:
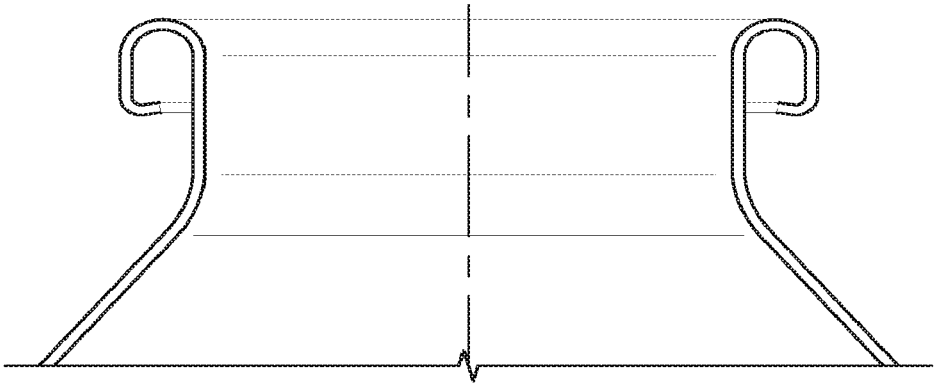

Although the shapes of the curls shown in the illustrated embodiments are generally circular or oval, it is contemplated that other shapes may also be formed, as shown, for example, in FIGS. 6*a* and 6*b*. As such, the term "radius," as used herein may still be applied in a corresponding way to non-circular or non-oval geometries and would be measured accordingly, e.g., as the distance between the straight sidewall 105A of the container 105 and the midpoint between the straight sidewall 105A of the container 105A and the outer portion of the curl.

Figure 7:
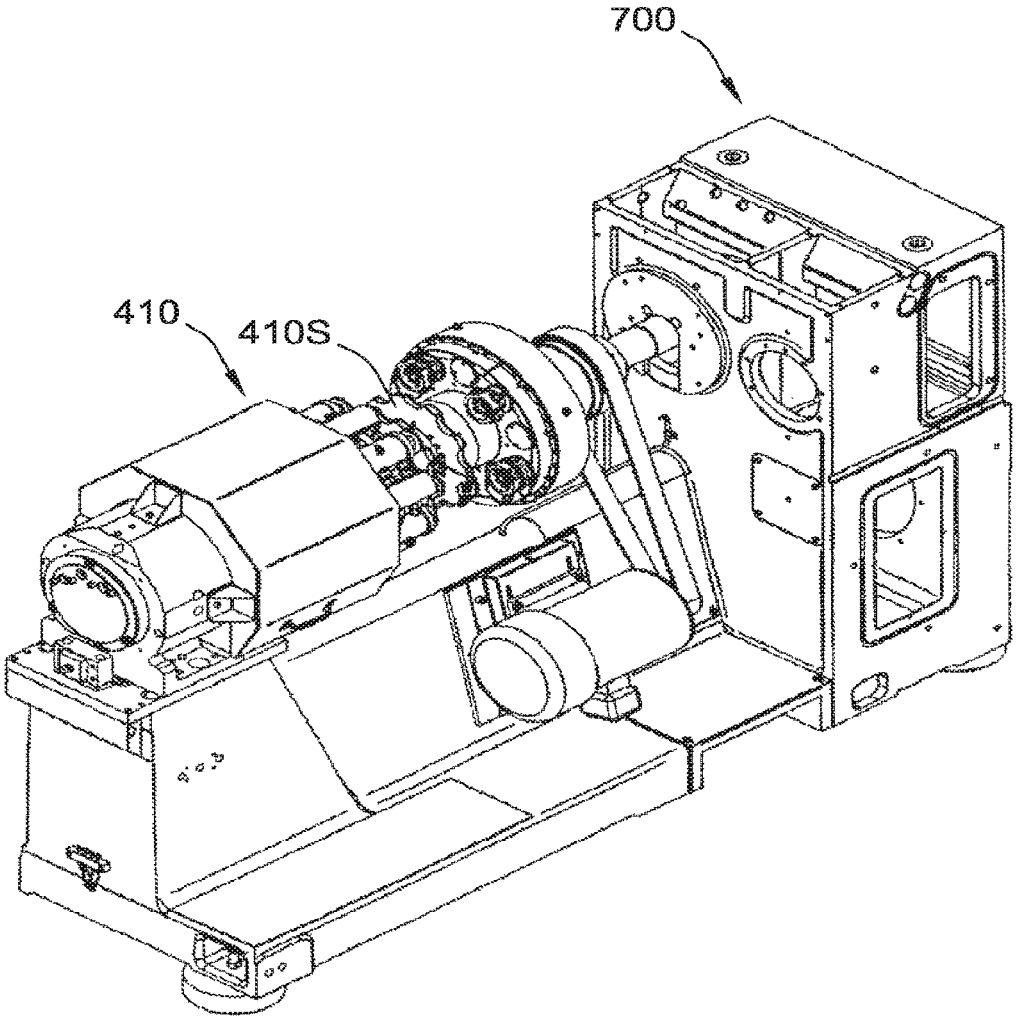
FIG. 7 is a perspective view of the can curling apparatus of FIG. 4.

While the invention is not so limited, embodiments of the invention are such that curling machines are constructed as modules 700, as shown, for example, in FIG. 7. The use of can curling modules allows for the machine line 411 to be assembled/changed to provide as many can curling stages as is required and to allow for the addition of additional stages such as flanging, necking, trimming, expansion, threading, and/or base reforming/reprofiling, which may be added/removed as desired.

In an embodiment, the turret star wheels 402, 410 may be composed of two segments, which are connected to a drive shaft by way of a timing plate. These timing plates are individually adjustable with respect to the respective turret drive shaft in a manner which allows their angular rotational position with respect to the turret drive shaft to be adjusted and then fixed to the degree that the two segments of the turret star wheel which are mounted thereon, are positioned/timed with respect to the transfer star wheels on either side thereof, so that a smooth, continuous, incident-free transfer of cans between the turret star wheels and the respective transfer star wheels, can take place.

The infeed star wheels, discharge star wheels, and/or the transfer star wheels 402, 410 may be arranged to hold the cans 105 in position using suction. The star wheels 402, 410 may have a vacuum port formed in a channel portion(s) that are fluidly communicating with a source of vacuum (negative pneumatic pressure) via a suitable manifold. The vacuum is delivered to the vacuum ports, and the surface area of the cans 105, which are exposed to the suction, is increased to a degree that the cans 105 are stably held in position as each can 105 passes below the transfer star wheel axis of rotation.

A shown in FIG. 7, for example, the forming rotating turrets 410 may comprise a positioning star wheel 410S at the straight wall 105A of the can 105, and the forming (curling) tooling 200 (see FIGS. 1, 2) at the open end of the can 105. The positioning star wheels 410S help keep the can 105 oriented and aligned with the forming tooling 200 to enable proper curling (forming) of the can 105.

Figure 8:
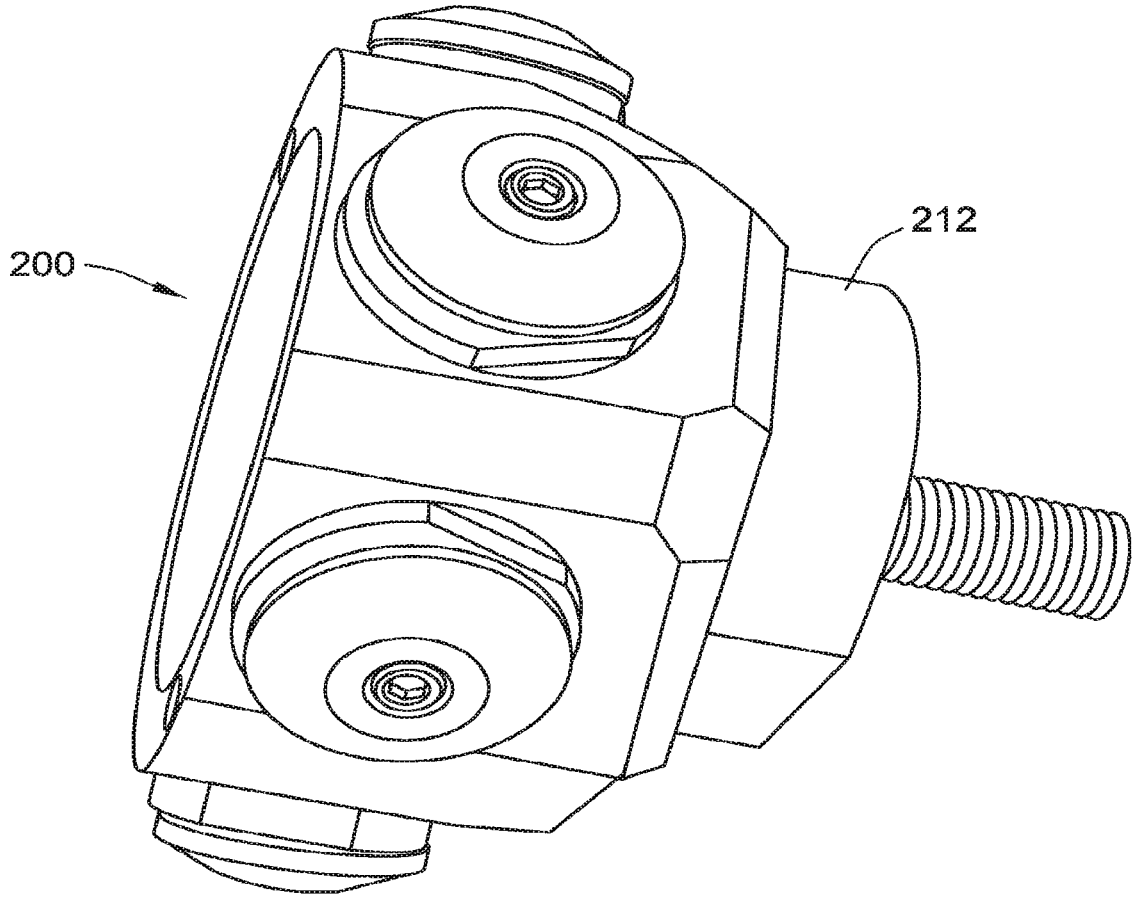
FIG. 8 is a perspective view of the forming tooling of FIG. 2.

The forming tooling (head) 200 may comprises multiple independent rollers mounted on a common head 212, as shown, for example, in FIG. 8. The rollers are mounted on bearings 240 (see FIG. 1) and are free spinning. The rollers 210 are independent such that each roller 210 can spin independently, that is, separately from the other rollers 210 in the forming tooling 200. Further, each roller in each set of rollers 210 may be adjusted, replaced, altered or repositioned to change the angle of the roller relative to the remaining rollers and/or a neck 105N of the can 105.

The forming tooling 200 is coaxial with the can 105. The forming tooling 200 rotates relative to the can 105 so that the rollers 120 are made to travel around the perimeter of the opening of the can 105. Although not shown in the illustrated embodiments, the forming tooling 200 may have multiple sets of rollers. One set of rollers may be shaped to form the inner portion of the curl 108, and another set of rollers may be shaped to form the outer portion of the curl 108.

The can 105 is moved by, e.g., a push ram assembly such that the open edge of the can 105 is positioned adjacent to the groove in the roller. When the can 105 is aligned relative to the rollers, the rollers 210 spin on opposite sides of the neck 105N of the can 105, thus turning an edge of the neck 105N into a curl 108. During this moment in the process, the turret 210 is continuously moving with the can 105 and the can 105 is moving axially into the forming tooling 200 and, thus, between the rotating rollers to form the curl 108.

Although the methods of forming a curl have been described herein with respect to machine line processes, it is contemplated that methods may also be applied in other (e.g., non-machine-line) processes.

While the invention is susceptible to various modifications and alternative forms, specific embodiments and methods thereof have been shown by way of example in the drawings and are described in detail herein. It should be understood, however, that it is not intended to limit the invention to the particular forms or methods disclosed, but, to the contrary, the intention is to cover all modifications, equivalents and alternatives falling within the spirit and scope of the invention.

What I claim is:

1. An apparatus for forming a curl on an article having a welded seam, the apparatus comprising:

a first forming tooling having a first set of rollers mounted on a common head, the first set of rollers having a respective groove having a first groove radius, the first set of rollers being configured to form a first curl having a first curl radius on an open end of the article;

a first rotating turret configured to load the article into the first forming tooling;

a second forming tooling having a second set of rollers mounted on a common head, the second set of rollers having a respective groove having a second groove radius, the second groove radius being larger than the first groove radius, the second set of rollers being configured to form a modified curl having a second curl radius near the top of the modified curl and maintain the first curl radius near the bottom of the modified curl;

a second rotating turret configured to load the article into the second forming tooling; and a first transfer star wheel configured to transfer the article from the first rotating turret to the second rotating turret.

2. The apparatus of claim 1, wherein the first set of rollers comprises one or more rollers and the second set of rollers comprises one or more rollers.

3. The apparatus of claim 1 further comprising:

a third forming tooling having a third set of rollers mounted on a common head, the third set of rollers having a respective groove having a third groove radius, the third radius being larger than the first groove radii;

a third rotating turret configured to load the article into the third forming tooling; and a second transfer star wheel configured to transfer the article from the second rotating turret to the third rotating turret.

4. The apparatus of claim 1, wherein the article is an aerosol can.

5. The apparatus of claim 1, wherein the first and second rotating turrets are continuously rotating.

6. The apparatus of claim 1, wherein the first set of rollers is configured to form a curl in a top edge of the article and the second set of rollers is configured to modify the curl formed by the first set of rollers.

7. The apparatus of claim 6, wherein the curl formed by the first set of rollers has a first curl radius and the modified curl formed by the second set of rollers has a second curl radius, the second curl radius being larger than the first curl radius.

8. A method of forming a curl in a top edge of an article, the method comprising:

feeding an article into a first rotating turret;

loading the article into a first forming tooling having a first set of rollers;

using the first set of rollers to form a curl in the top edge of the article, the curl having a first radius;

transferring the article having the curl to a second rotating turret;

loading the article having the curl into a second forming tooling having a second set of rollers;

using the second set of rollers to modify the curl, the modified curl having a second radius near the top of the modified curl and a third radius near the bottom of the modified curl, the second radius being larger than the first radius, the third radius being generally the same as the first radius.

9. The method of claim 8, wherein the first set of rollers comprises one or more rollers and the second set of rollers comprises one or more rollers.

10. The method of claim 8, wherein the article is an aerosol can.

11. The method of claim 8, wherein the first and second rotating turrets are continuously rotating.

12. The method of claim 8, wherein the transferring of the article is performed by a transfer star wheel.

13. The method of claim 8, wherein the first set of rollers has a respective first groove used to form the curl and the second set of rollers has a respective second groove used to modify the curl, the second groove having a larger groove radius than the first groove.

14. The method of claim 8, further comprising:

transferring the article having the modified curl to a third rotating turret;

loading the article having the modified curl into a third forming tooling having a third set of rollers;

using the third set of rollers to further modify the curl, the further modified curl having a third radius, the third radius being larger than the first and second radii.

* * * * *